United States Patent [19]

Isakov et al.

[11] Patent Number: 4,903,609

[45] Date of Patent: Feb. 27, 1990

[54] TAMPING BLADE WITH IMPROVED INSERTS

[75] Inventors: Edmund Isakov, Raleigh, N.C.; Terry A. Manway, Monroeville, Pa.

[73] Assignee: Kennametal Inc., Latrobe, Pa.

[21] Appl. No.: 248,861

[22] Filed: Sep. 23, 1988

[51] Int. Cl.[4] ..... E01B 27/16

[52] U.S. Cl. ..... 104/10; 104/12; 37/142 R; 299/91

[58] Field of Search ..... 104/10, 12; 299/79, 299/97; 172/719; 37/142 R

[56] References Cited

U.S. PATENT DOCUMENTS

| | | | |
|---|---|---|---|
| 3,326,302 | 6/1967 | Washbond et al. | 37/142 R |
| 3,793,960 | 2/1974 | McKenry | 104/10 |
| 3,971,323 | 7/1976 | Beiswenger | 104/10 |
| 4,024,902 | 5/1977 | Baum | 104/10 |
| 4,062,291 | 12/1977 | Vicket et al. | 104/10 |
| 4,068,594 | 1/1978 | Crowell | 104/10 |
| 4,146,080 | 3/1979 | Baum | 104/10 |
| 4,480,874 | 11/1984 | Shaw | 299/91 |
| 4,606,275 | 8/1986 | Grant | 104/10 |

*Primary Examiner*—Andres Kashnikow
*Assistant Examiner*—Matthew C. Grahah
*Attorney, Agent, or Firm*—Thomas R. Trempus

[57] ABSTRACT

A tamping pad includes cutout along the length of the leading edge thereof to support at least one wear-resistant insert rigidly positioned therein. The wear-resistant insert comprises a body having a first side and a second opposed side, first and second opposed major surfaces and first and second opposed shoulders. The first side of the insert body defines a tamping blade leading edge which is arcuate in shape between the opposed shoulders. The arcuate leading edge of the insert body has a radius which defines the length of the arcuate edge to be of a ratio of about 1.3 relative to the width of the carbide insert. Preferably, the plurality of inserts extends end to end along the length of the leading edge of the blade to define the interrupted leading edge of the tamping pad as formed by the curvilinear leading edge of each of the plurality of inserts.

19 Claims, 3 Drawing Sheets

TAMPING BLADE WITH IMPROVED INSERTS

FIELD OF THE INVENTION

The present invention relates to an improved tamping pad and is particularly directed to an improved tamping blade and tamping blade insert for use in connection with railroad ballast tamping machines.

BACKGROUND OF THE INVENTION

Tamping machines are used to repair and correct the ballast around and beneath railroad ties so that the road bed can uniformly support the passage of railroad trains over it. Tamping machines are designed to move along the road bed and to force at least eight tamping pads into the ballast, one pad on each side of each tie on each side of each rail. The tamping pads are then vibrated and moved toward the tie in unison to compact the ballast under the tie and provide a firm foundation around and beneath the tie. The railroad bed, in turn, provides a solid foundation for the heavy loads encountered as a train passes thereover.

A typical problem encountered by the tamping tools currently available is that the typical ballast materials are highly abrasive, i.e., sand and ballast rock, gravel and cinders. The leading edges of the tamping pads wear away extremely rapidly and, when partly worn, are deficient for carrying out the tamping and squeezing operations efficiently. Thus, the tamping pads must be replaced or the leading edges of the tamping pads rebuilt.

It is known in the art to face the edges of the tamping pads with a high chromium-steel braze to provide added wear resistance. Even with chromium-steel facing, a normal run of the tamping machine is only four to six miles of road bed before the edges of the tamping pad are worn to the point where replacement is necessary for efficient operation.

The wear life of the tamping pad has been substantially increased by providing a tamping pad consisting of a tamping blade and a tungsten carbide insert in the leading edge of the tamping blade. Such a tamping blade is described in U.S. Pat. No. 3,793,960, which is assigned to the assignee of the present invention. This patent teaches a carbide insert which is nested and brazed into a groove formed in the leading edge of the tamping blade. The carbide insert is of sufficient bulk and is adequately supported to avoid chipping, cracking and spalling of the insert under the heavy impact loading to which the leading edge of the blade is exposed.

While it has been found that the construction of the tamping tool according to U.S. Pat. No. 3,793,960 substantially increases the life of the tamping blade, it remains a continuing objective in the industry to increase the wear life of the tamping tool. Another attempt to increase the life of the tamping blade is found in U.S. Pat. No. 3,971,323, entitled "Tamping Blade and a Hard Wear-Resistant Insert Therefor," to Richard W. Beiswenger. This patent teaches a tamping blade having a plurality of wear-resistant inserts positioned end to end in a cut out at the leading edge of a blade shoe of steel. Each insert according to this patent has first and second opposed sides and first and second opposed major surfaces with the major surfaces being angular to each other to provide a substantially uniform thickness to the body at each of these sides. The first side of each insert has a thickness of at least about ⅜ inch and is adapted to provide a leading edge for the tamping blade extending across the thickness of the tamping blade beyond the leading edge thereof. The first major surface is adapted to provide a wear resistant facing for the tamping blade during lateral movement. While the tamping tool of U.S. Pat. No. 3,971,323 does provide advancement to the art of tamping tools and provides a longer useful life than the conventional practice of utilizing a high chromium-steel braze to provide adequate wear resistance, limitations still exist in the wear-resistant inserts.

The present invention overcomes these difficulties and disadvantages and provides a tamping pad with a substantially prolonged useful life. A tamping pad according to this invention provides a tamping blade with carbide inserts. The tamping blade has an interrupted leading edge defined by a plurality of arcuate edges along the entire leading edge of the tamping blade. Moreover, the tamping blade of this invention in combination with the insert design, significantly enhance the useful life of a tamping blade.

SUMMARY OF THE INVENTION

A tamping pad is provided which has a blade adapted for mounting on the lower end of a tamping arm. The blade has a cutout along the length of the leading edge thereof to support at least one wear-resistant insert. Then at least one wear resistant insert is rigidly positioned in the cutout of the blade typically by brazing according to well-known techniques. Alternatively, it is also possible to secure the wear-resistant insert within the cutout of the blade through a casting process in which the wear-resistant inserts are supported within the pattern in which the tamping blade is cast. The wear-resistant insert of this invention comprises a body having a first side and a second opposed side, first and second opposed major surfaces and first and second opposed shoulders. The first and second opposed major surfaces define therebetween a thickness of the insert body. The first and second opposed shoulders defined therebetween the width of the insert body. The first side of the insert body defines a leading edge for a tamping blade. The leading edge is arcuate in shape between the opposed shoulders. The second side and the second major surface are adapted to support the insert body on the tamping blade for impact loading of the first side of the insert body. Additionally, the first and second opposed major surfaces are preferably substantially parallel to each other. The first side of the insert body has a first relief surface extending inwardly from the first opposed major surface to the leading edge. The first side of the insert body further includes a second relief surface extending inwardly from the second opposed major surface to the leading edge. The first relief surface defines an arcuate line of intersection with the first opposed major surface. The second relief surface also defines an arcuate line of intersection with the section opposed major surface. Preferably, the first relief surface defines a rake angle of between about 0 and 15 degrees (negative) relative to the first opposed major surface, preferably, 10 degrees negative relative thereto. The second relief surface defines an included angle of between about 65 and 85 degrees relative to the second opposed major surface, preferably, 70 degrees relative to the aforesaid surface. The arcuate leading edge of the first side of the insert body has a radius "R" which defines the length of the arcuate edge to be of a ratio of about 1.3 relative to the width "W" of the carbide insert, i.e., $R=1.3\ W$.

Preferably, the plurality of inserts extends end to end along the length of the leading edge of the blade to define the interrupted leading edge of the tamping pad as formed by the curvilinear leading edge of each of the plurality of inserts. The insert is typically made by pressing and sintering by established techniques. Such techniques involve substantial shrinkage of the insert during manufacture and damage can occur when any dimension of the insert is too large. For this reason, it is preferred that the length of the insert be kept to a reasonable dimension and that a plurality of inserts be positioned end to end to extend the length of the leading edge of the blade shoe.

Other details, objects and advantages of the invention will become apparent as the following description of the presently preferred embodiments of the invention and presently preferred ways of making and practicing the same is set forth.

BRIEF DESCRIPTION OF THE DRAWINGS

The above, as well as other features and advantages of the present invention, can be appreciated through consideration of the several drawings in which.

DESCRIPTION OF THE PREFERRED EMBODIMENTS

Figure 1:
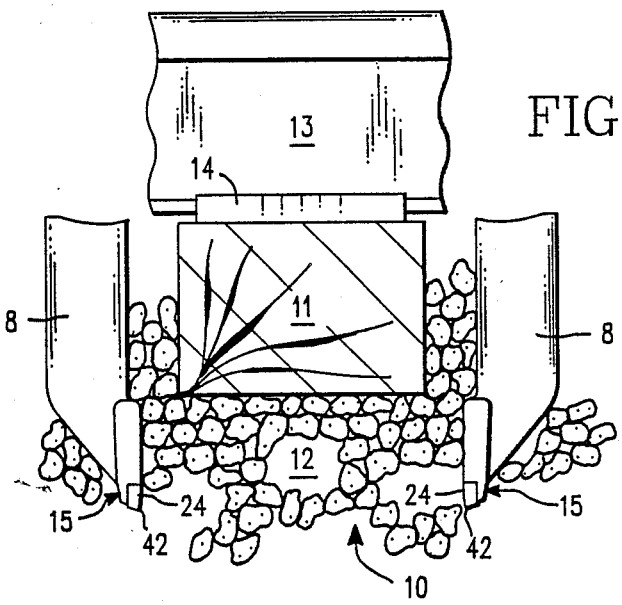
FIG. 1 is a fragmentary, schematic side view showing the operation of tamping pads embodying the present invention.

Referring to FIG. 1, a conventional roadbed 10 is comprised of a plurality of spaced apart, substantially parallel roadbed ties, such as tie 11, embedded in ballast 12. Rails 13 are supported on rail plates 14, which are in turn supported on ties 11. When the roadbed requires leveling, a tamping machine (not shown) of known construction is rolled along rails 13, and a plurality of support arms 8 are manipulated and deployed by suitable hydraulic power means at each tie in turn. At least eight and typically sixteen tamping pads generally indicated at 15 are individually extended from the support arms 8, with at least one and typically two blades on each side of each rail 13 at each end of tie 11. Each tamping blade 15 has a leading edge 42 which is forced into ballast 12 as shown. Tamping blades 15 are thereafter vibrated and moved toward tie 11 in unison to raise the tie to a fixed level while tamping the ballast under the tie.

Figure 2:
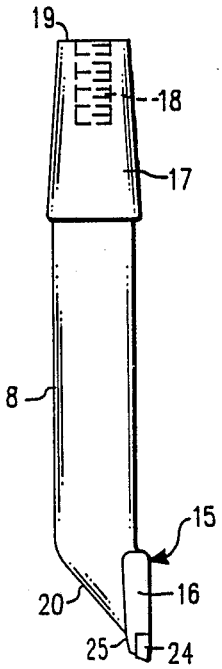
FIG. 2 is a side view of the tamping blade embodying the present invention.
Figure 3:
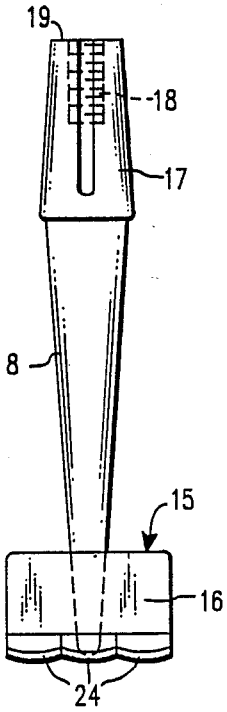
FIG. 3 is an elevational side of the tamping blade shown in FIG. 2.
Figure 4:
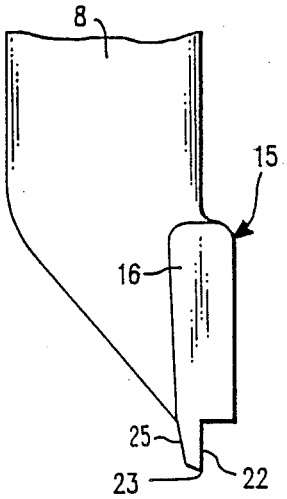
FIG. 4 is an enlarged fragmentary side view of the leading edge of the tamping blade shown in FIG. 2, without the tamping blade insert of the present invention.

Referring to FIGS. 2 and 3, tamping blade 15 is shown in more detail. Blade 15 support arm 8 has support shaft portion 17 that has a threaded opening 18 in the end 19 thereof to fasten the blade to a corresponding support arm. Support arm 8 also has tapered stem portion 20 extending to an integral blade plate or pad 16 at the opposite end thereof. Blade pad 16 has recess or cutout 22 (see FIG. 4) extending across leading edge 23 of the forward portion or face thereof and into which tamping blade inserts 24 are brazed end to end (see FIGS. 3, 7 and 9). The blade pad 16 has a rear face 25 and a relief face 27 extending between the rear face 25 and the leading edge 23. Typically, tamping blade 16 is about four inches long, about three inches in height, and about 0.75 inch in thickness. However, as can be seen if FIG. 9, the alternative embodiment of the tamping blade 116 can be modified to include four inserts. These tamping blade 116 may be of the same or similar dimension as the tamping blade 16 or it may be longer, depending upon the application of the tamping machine onto which it is to be mounted.

Tamping blade 16 may be a new blade drop forged with cutout 22 for support of blade inserts 24 or cast in a pattern. Alternatively, tamping blade 15 may be made from an existing blade by milling cutout 22 in leading edge 23. In any of the aforedescribed embodiments, cutout 22 typically extends the width of the leading edge and is about 0.41 inch deep.

Figure 7:
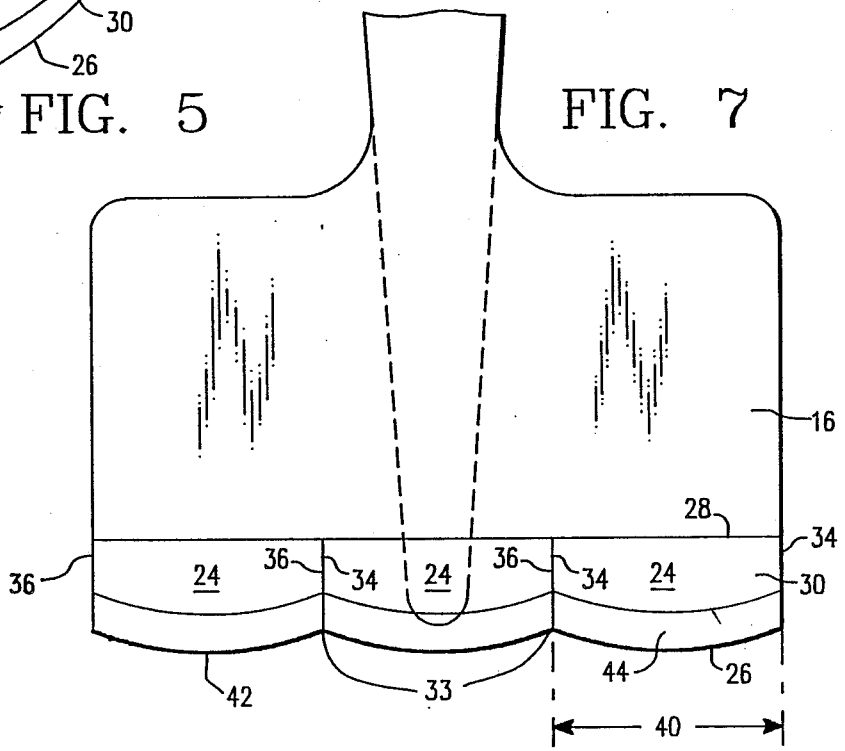
FIG. 7 is an enlarged fragmentary elevational view of the leading edge of the tamping blade insert shown in FIG. 3.

Tamping blade insert 24 is preferably made of tungsten carbide by established sintering techniques. That is, a powder of tungsten carbide is molded under pressure and thereafter fired in a sintering furnace to a hard wear-resistant body. The difficulty with the sintering of tungsten carbide is that substantial shrinkage occurs. The insert must, therefore, be maintained relatively small to avoid warpage from occurring in any dimension. Also, larger inserts have more of a tendency to crack during the subsequent brazing or casting processes used to attach inserts to tamping blade 16. For these reasons, it is preferred that the length of the insert be kept small, and a plurality of inserts be positioned end-to-end along preferably the entire length of the leading edge of the blade pad as best shown in FIG. 7.

Figure 6:
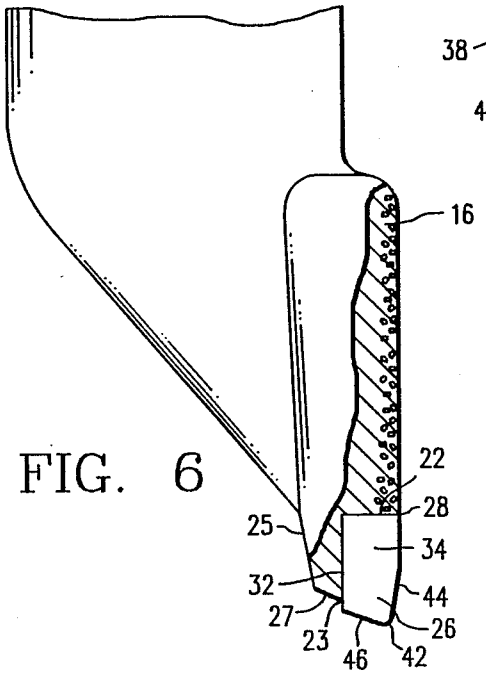
FIG. 6 is an enlarged fragmentary side view of a leading edge of a tamping blade shown in FIG. 2.

Irrespective of the embodiment, the tamping blade insert may be assembled with the tamping blade in any suitable way. The inserts are assembled with the tamping blade as shown in FIGS. 6 and 7, with the inserts brazed into the cutouts end-to-end as shown. Bevels (not illustrated) can be provided at the ends of tamping pad 16, and spaces 33 can be provided between the ends of adjacent tamping inserts 24 to further rigidly braze the tamping inserts into cutout 22.

Figure 5:
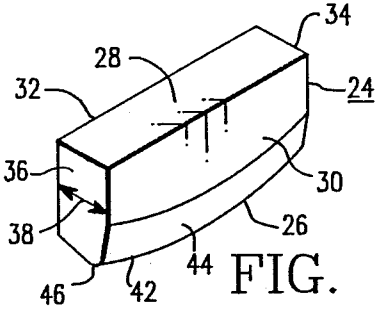
FIG. 5 is an enlarged perspective view of the tamping blade insert of the present invention.

Referring to FIG. 5, tamping blade insert generally indicated by the reference character 24 is comprised of a body of hard wear-resistant material having first and second sides 26 and 28, respectively, and first and second preferably planar major surfaces 30 and 32, respectively, and first and second opposed shoulders 34 and 36, respectively. The first and second opposed major surfaces 30 and 32 define therebetween a thickness indicated at 38 of the body of the insert 24. The first and second opposed shoulders 34 and 36, respectively, define therebetween a width generally indicated at 40 of the body of the insert 24. The first side 26 of the insert body 24 defines a leading edge indicated at 42 for a tamping blade insert. The leading edge 42 is interrupted arcuate in shape as defined between the opposed shoulders 34 and 36 and is preferably interrupted and curvilinear. The second side 28 and the second opposed major surface 32 are adapted to support the body 24 on the tamping blade for impact loading of the first side 26 of the insert body 24.

The first side 26 of the body 24 has a first relief section 44 extending inwardly from the first opposed major surface 30 to the leading edge 42. Additionally, the first side 26 of the insert body 24 has a second relief surface 46 extending inwardly from the second opposed major surface 32 to the leading edge 42 of the first side. The first relief surface 44 defines a rake angle of between about 0 and 15 degrees relative to the first opposed major surface 30. Preferably, the first relief surface 44 defines a rake angle of about 10 degrees relative to the first opposed major surface 30. The second relief surface 46 defines an included angle of between about 65 and 85 degrees relative to the second opposed major surface 32. Preferably, the second relief surface 46 defines an included angle of about 70 degrees relative to the second opposed major surface 32.

The leading edge 42 of the first side 26 of the insert body has a radius which defines the length of the arcuate edge to be of a ratio of between about 1.2 and 1.5 the width of the insert as shown in FIG. 7. Preferably, the leading edge has a length relative to the width of the carbide insert as shown in FIG. 7 of about 1.3. In the preferred embodiment, the first and second opposed major surfaces 30 and 32 are substantially parallel to each other. The unique arcuate or curvilinear design of the leading edge 42 of the first side of the insert body 24 provides enhanced operational characteristics.

It is extremely desirable to utilize carbide in a mode which allows for compressive forces to be acting on the carbide insert. When used under compression, bending is avoided and the forces acting on the carbide insert are radially distributed along the leading edge 42 of the insert. Particularly during penetration of the railroad bed, the arcuate or curvilinear design of the present invention has been shown to substantially enhance insert life. Moreover, the use of multiple inserts as shown in the figures provides the tamping pad with an interrupted edge. As formulated by the multiple arcuate or curvilinear leading edges of the inserts of this invention, the leading edge of the tamping pad distributes the forces occurred during penetration of the tool into the railroad bed.

Figure 8:
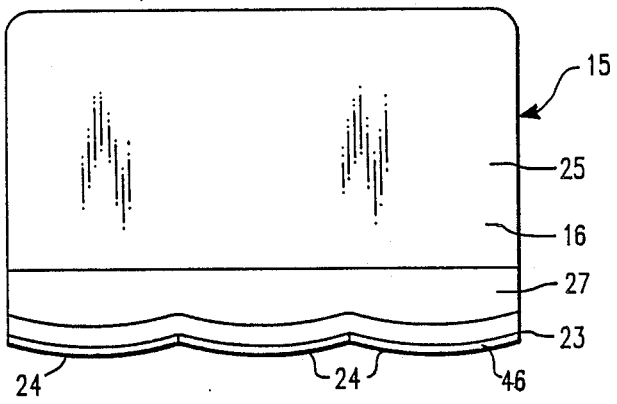
FIG. 8 is a rear view of the tamping blade embodying the present invention.
Figure 9:
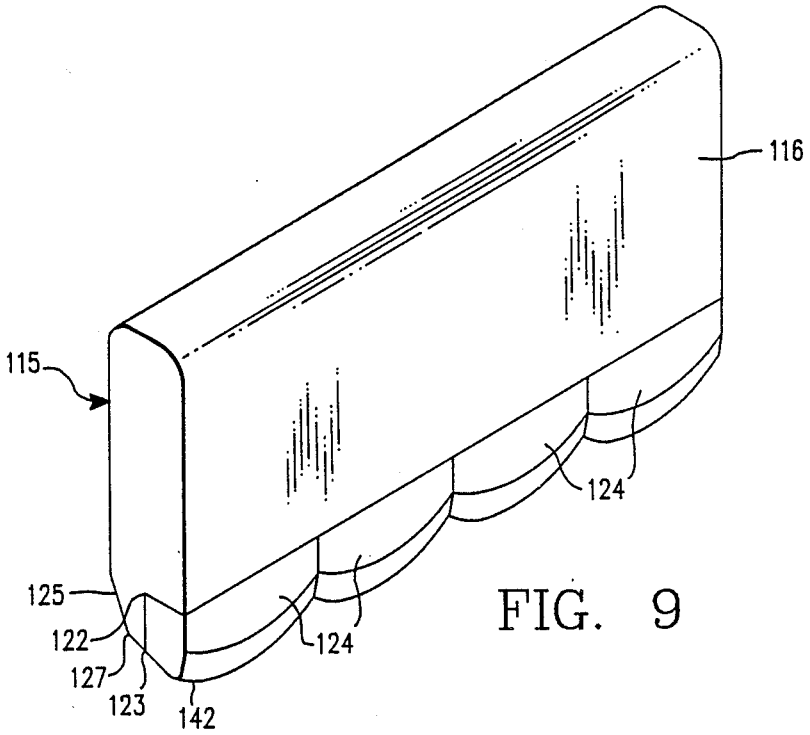
FIG. 9 is a perspective view of an alternative embodiment of the tamping blade of the present invention.

As can be seen in FIGS. 8 and 9, it is desirable to form the rear face 25, 125 the leading edge 23, 123 and the relief face 27, 127 extending therebetween, into a curvilinear or arcuate configuration which conforms with and is complimentary to the configuration of tamping blade inserts 24, 124.

Because of the extended life provided to the tamping pad by the inserts 24 of the present invention, it has been found to be advantageous to enhance the wear characteristics of the tamping blade, itself. However, it should be noted that not all surfaces of the tamping blade are subject to equivalent levels of wear due to the nature of the contact with the abrasive materials of the railroad bed. Accordingly, it has been found that not all surfaces of the tamping blade are subject to equal degrees of wear and that, therefore, it is most useful to provide wear protective characteristics to certain portions only of the tamping blade. While, it is, of course, possible to enhance all of the wear surfaces of the tamping blade, such enhancements could lead to excessive manufacturing costs with no real benefit to the resulting product. Therefore, in order to maximize tool life while, at the same time, maintaining reasonable manufacturing costs and considerations, it has been found desirable that the face of the blade 16 be provided with improved wear-resistant characteristics.

For example, the leading or penetrating edge 24 composed of cemented carbide inserts is subject to the most severe wear as a result of the action of the tamping machine driving the pad vertically downward into the ballast. However, the subsequent compressing and vibrating action of the entire assembly also places significant stress and wear on the face of the tamping blade. This area if left unprotected (relying only on the wear resistant properties of standard or heat treated steels as are normally used for the subassemblies to which carbide inserts are brazed) would erode and eventually cause the premature failure of the tool, even though the carbide inserts would still be protecting the leading edge. It is the conventional practice to leave this area unprotected.

To a lesser extent than face of the tamping blade, the opposite or back side of the tamping blade also experiences wear from the same vibrating and compressing actions of the tool. In order to optimally balance the wear life of all of the three areas in a cost effective manner, the current invention utilizes a composite cast material comprised of crushed cemented tungsten carbide and a specifically formulated alloy steel which has air hardening properties. This composite cast material is manufactured by a process protected and described in U.S. Pat. Nos. 4,024,902 and 4,146,080, to Charles S. Baum and assigned to Permanence Corporation. The contents of these patents are incorporated herein by reference as if fully set forth.

Through the use of this material, layers of crushed tungsten carbide scrap preferably having a 6 to 8 percent cobalt content and screened to A $-\frac{1}{4}$, $+4$ mesh size (although combinations of various grit sizes are sometimes used) can be selectively placed in higher wear areas. The carbide is encased within and metallurgically bonded to a specially formulated alloy steel containing preferred levels of carbon, chrome, nickel, molybdenum and other elements, and having an "as cast" hardness of approximately 50–54 Rockwell "C".

This material is well suited to the application for the following reasons. Compared with virgin sintered carbide, the crushed scrap is very economical. The metallurgical bond between the carbide and the steel significantly enhances the wear properties of the material when compared with alternate methods of incorporating crushed scrap carbide. The composite material is much more ductile than and resistant to breakage than tungsten carbide alone and is, therefore, preferred over alternate attempts by manufacturers of tamper tools to protect the face which involves brazing a thin solid carbide insert covering a relatively broad surface area and lacking sufficient bulk to resist chipping and fracture. Tools manufactured using the latter concept fail due to impact and braze stress. The composite material relies on the spherical shape of the carbide and the steel between the carbide grains to absorb shock and arrest fractures. The Baum process combines the manufacture of the main body of the pad and the incorporation of the carbide into one step, thereby saving operations in the manufacture of the tamping blade. The back or opposite face is also more suitably protected because the alloy steel portion of the composite material has higher hardness values than materials typically used and, therefore, more wear resistance. The rear surface of the pad, even with its increased hardness, is still very easily weldable and brazable; very desirable characteristics to simplify attachment of the pad to the shank, and an advantage over tool steels which are used by some manufacturers of tamper tools.

While the presently preferred embodiments of the invention and the methods for performing and making them have been specifically described, it is distinctly understood that the invention may be otherwise variously embodied and used within the scope of the following claims.

What is claimed is:

1. A tamping blade insert comprising:

a body of hard wear-resistant material having a first side and a second opposed side, first and second opposed major surfaces, said surfaces defining therebetween a thickness of the body, and first and second opposed shoulders defining therebetween a width of the body;

said first side of said body defining a leading edge for a tamping blade, said leading edge being arcuate in shape between the opposed shoulders, and a first relief surface extending inwardly from said first opposed major surface to said leading edge;

said second side and said second major surface being adapted to support the body on said tamping blade for impact loading of said first side of said body.

2. The tamping blade insert according to claim 1 wherein the first and second opposed major surfaces are substantially parallel to each other.

3. The tamping blade insert according to claim 1 wherein the first relief surface defines an arcuate line of intersection with the first opposed major surface.

4. The tamping blade insert according to claim 1 wherein the first relief surface defines an angle of between about 0 and 15 degrees negative relative to the first opposed major surface.

5. The tamping blade insert according to claim 4 wherein the first relief surface defines an angle of about 10 degrees negative relative to the first opposed major surface.

6. The tamping blade insert according to claim 1 wherein the leading edge has a radius such that the length of the leading edge is of a ratio of between about 1.2 and 1.5 relative to the insert width.

7. The tamping blade insert according to claim 6 wherein the leading edge has a radius such that the length of the leading edge is of a ratio of about 1.3 relative to the insert width.

8. The tamping blade insert according to claim 1 wherein the first side of the body has a second relief surface extending inwardly from the second opposed major surface to the leading edge.

9. The tamping blade insert according to claim 8 wherein the second relief surface defines an arcuate line of intersection with the second opposed major surface.

10. The tamping blade insert according to claim 8 wherein the second relief surface defines an included angle of between about 65 and 85 degrees relative to the second opposed major surface.

11. The tamping blade insert according to claim 10 wherein the second relief surface defines an included angle of about 70 degrees relative to the second opposed major surface.

12. A tamping blade comprising:

a blade shoe of steel adapted for mounting on an end of a support arm, said blade shoe having a cut-out at a leading edge thereof to support at least one wear resistant insert; and at least one wear resistant insert rigidly positioned in said cut-out of the blade shoe, said at least one insert being of wear resistant material and comprising:

a body having a first side and a second opposed side, first and second opposed major surfaces, said surfaces defining therebetween a thickness of the body, and first and second opposed shoulders defining therebetween a width of the body;

said first side of said body defining a leading edge for a tamping blade, said leading edge being arcuate in shape between the opposed shoulders, and a first relief surface extending inwardly from the first opposed major surface to the leading edge;

said second side and said second major surface being adapted to support the body on said tamping blade for impact loading of said first side of said body.

13. The tamping blade according to claim 12 wherein the first and second opposed major surfaces are substantially parallel to each other.

14. The tamping blade according to claim 12 wherein the first relief surface defines an arcuate line of intersection with the first opposed major surface.

15. The tamping blade according to claim 12 wherein three wear resistant inserts are rigidly positioned in the cut-out of the blade shoe.

16. The tamping blade according to claim 12 wherein the blade shoe of steel adapted for mounting on an end of a support arm further includes at least a forward vertical wear surface adjacent the cut-out at the leading edge thereof and said wear surface includes carbide material cast therein.

17. The tamping blade according to claim 12 wherein the first side of the body has a second relief surface extending inwardly from the second opposed major surface to the leading edge.

18. The tamping blade according to claim 17 wherein the second relief surface defines an arcuate line of intersection with the second opposed major surface.

19. A tamping blade insert comprising:

a body of hard wear-resistant material having a first side and a second opposed side, first and second opposed major surfaces, said surfaces being substantially parallel to each other and defining therebetween a thickness of the body, and first and second opposed shoulders defining therebetween a width of the body;

said first side of said body defining a leading edge for a tamping blade, said leading edge being arcuate in shape between the opposed shoulders and said first side of said body having a first relief surface extending inwardly from said first opposed major surface to said leading edge and a second relief surface extending inwardly from said second opposed major surface to said leading edge;

said second side and said second major surface being adapted to support the body on said tamping blade for impact loading of said first side of said body.

* * * * *